US009085344B2

(12) United States Patent
Dubé

(10) Patent No.: US 9,085,344 B2
(45) Date of Patent: Jul. 21, 2015

(54) BOAT WINDSHIELD WITH HIDDEN FRAME STRUCTURE

(71) Applicant: Prelco Inc., Riviére-du-Loup (CA)

(72) Inventor: Simon Dubé, Riviére-du-Loup (CA)

(73) Assignee: Prelco Inc. (CA)

( * ) Notice: Subject to any disclaimer, the term of this patent is extended or adjusted under 35 U.S.C. 154(b) by 0 days.

(21) Appl. No.: 14/149,897

(22) Filed: Jan. 8, 2014

(65) Prior Publication Data

US 2014/0190391 A1 Jul. 10, 2014

Related U.S. Application Data

(60) Provisional application No. 61/750,094, filed on Jan. 8, 2013.

(51) Int. Cl.
*B63B 17/00* (2006.01)
*B63B 19/02* (2006.01)

(52) U.S. Cl.
CPC ..... *B63B 19/02* (2013.01)

(58) Field of Classification Search
CPC ..... B63B 19/00; B63B 19/02; B63B 17/02
USPC ..... 114/343, 361, 364
See application file for complete search history.

(56) References Cited

U.S. PATENT DOCUMENTS

| | | | | |
|---|---|---|---|---|
| 2,224,186 | A | 12/1940 | Henri-Labourdette | |
| 5,970,904 | A | 10/1999 | Wellen et al. | |
| 6,647,915 | B1 | 11/2003 | Bach | |
| 7,418,917 | B2 * | 9/2008 | Bach | 114/361 |
| 7,441,510 | B1 * | 10/2008 | Bach | 114/361 |
| 7,591,231 | B2 | 9/2009 | Shearer et al. | |
| 8,166,725 | B2 | 5/2012 | Griffith | |
| 8,656,594 | B2 | 2/2014 | Griffith | |
| 2008/0245288 | A1 * | 10/2008 | Bach | 114/361 |

* cited by examiner

*Primary Examiner* — Daniel V Venne
(74) *Attorney, Agent, or Firm* — Benoît & Côté Inc.

(57) ABSTRACT

The present document describes a boat windshield assembly for installation on a boat deck, the boat windshield assembly comprising a hidden frame structure having an upper frame member; and a windshield comprising a lower edge and an upper edge opposite the lower edge, the lower edge running near the boat deck and the upper edge running near the upper frame member, the windshield substantially hiding the upper frame member; wherein the upper edge of the windshield and the upper frame member together define an upper channel for use in securing a boat covering device to the boat windshield assembly.

16 Claims, 9 Drawing Sheets

BOAT WINDSHIELD WITH HIDDEN FRAME STRUCTURE

CROSS-REFERENCE TO RELATED APPLICATIONS

This application claims priority of U.S. provisional patent application No. 61/750,094 filed on Jan. 8, 2013, the specification of which is hereby incorporated by reference.

BACKGROUND (a) Field

The subject matter disclosed generally relates to windshields for vehicles. More particularly, the subject matter relates to boat windshields and their associated mounting structure.

(b) Related Prior Art

A boat windshield must be installed on a boat deck in order to protect the occupants of the boat from elements such as, without limitation, rain, wind, any other external element, and the like. In addition to protecting the occupants of the boat, the windshield may often be used to attach a boat covering device such as, without limitation, a boat roof, a boat protection or other components on upper and/or lower frame members of the windshield. The windshield may also be used to attach other boat equipments, such as, without limitations, boat lights, boat mirrors, boat speakers, and the like. Finally, the windshield may also often have an aesthetic function in the complete assembly of the boat.

Currently, it is possible to find on the market windshields assembled with a frame structure visible from the outside (i.e., when the boat is coming towards us). This frame structure is also often used to attach a boat covering device. Some windshields on the market use a design with no apparent structure on the top and bottom of the windshield but, these windshields with no apparent structure on the top and bottom of the windshield do not allow the ability to attach equipment (i.e., a boat covering device, a boat mirror, a boat speaker, boat lights) on the windshield at its top and/or bottom.

There is therefore a need for an improved boat windshield without apparent structure for use in securing at least a boat covering device to the boat windshield.

SUMMARY

According to an embodiment, there is provided a boat windshield assembly for installation on a boat deck, the boat windshield assembly comprising: a hidden frame structure having an upper frame member; and a windshield comprising an upper edge running along the upper frame member when installed on the hidden frame structure, the windshield substantially hiding the upper frame member; wherein the upper edge of the windshield and the upper frame member together define an upper channel for use in securing a boat covering device to the boat windshield assembly.

According to another embodiment, the upper frame member further comprises an upper frame attachment section for attachment to the windshield and a ledge extending from and above the upper frame attachment section, wherein the upper edge and the ledge run parallel to each other and form an upper passage to access the upper channel.

According to a further embodiment, at least a portion of the ledge extends above the upper edge.

According to yet another embodiment, at least a portion of the ledge remains below and behind the upper edge.

According to another embodiment, the boat windshield assembly further comprises an upper frame attachment device removably mounted on the upper frame member, the upper frame attachment device comprising a fastener for removably connecting with a boat covering device.

According to a further embodiment, the upper frame member comprises a longitudinal groove and wherein the upper frame attachment device comprises a first lip and a second lip, the second lip is for introduction in the upper passage while the first lip is for introduction in the longitudinal groove thereby securing the upper frame attachment device to the upper frame member.

According to yet another embodiment, the fastener of the upper frame attachment device comprises a snap fastener for removably connecting with a corresponding fastener on the boat covering device.

According to another embodiment, the boat windshield assembly further comprises a boat covering device molding slidably mounted within the upper channel of the upper frame member, the boat covering device molding being attached to the boat covering device.

According to a further embodiment, the hidden frame structure further comprises a lower frame member and the windshield comprises a lower edge opposite the upper edge, the lower edge running along the lower frame member, the windshield substantially hiding the lower frame member.

According to yet another embodiment, the windshield further comprises windshield surface bands along the lower edge and along the upper edge respectively and wherein the hidden frame structure comprises a frame structure surface on the hidden frame structure, the boat windshield assembly further comprises an adhesive material for fixing the windshield surface bands to the frame structure surface.

According to another embodiment, the lower frame member comprises a lower track for use in securing the boat windshield assembly to the boat deck.

According to a further embodiment, the lower frame member further comprises a lower frame attachment section for attachment to the windshield and a ledge extending from and below the lower frame attachment section, wherein the lower frame attachment section, the boat deck and the ledge together form a lower channel, the lower channel for use in securing the boat covering device to the boat windshield assembly.

According to yet another embodiment, the lower frame attachment section comprises a lower track, and the boat windshield assembly further comprises a lower frame attachment device for mounting on the boat deck, the lower frame attachment device comprising a mounting section and a lip extending outwardly and downwardly from the mounting section, the lip of the lower frame attachment device for slidably mounting on the lower track.

According to another embodiment, the mounting section of the lower frame attachment device comprises a fixed mounting section mounted on the boat deck and a removable mounting section for slidably mounting on the fixed mounting section.

According to a further embodiment, the removable mounting section comprises an interfacing flat portion, a first lip and a second lip, the first lip and the second lip extending from and below the interfacing flat portion for slidably engaging with sides of the interfacing flat portion.

According to yet another embodiment, the boat windshield assembly further comprises a boat covering device molding slidably mounted within the lower channel of the lower frame member, the boat covering device molding connecting with a boat covering device.

According to another embodiment, there is provided a boat windshield assembly for installation on a boat deck, the boat windshield assembly comprising: a hidden frame structure having an upper frame member; and a windshield comprising an upper edge running along the upper frame member when installed on the hidden frame structure, the windshield substantially hiding the upper frame member.

According to a further embodiment, the hidden frame structure further comprises a lower frame member and the windshield comprises a lower edge opposite the upper edge, the lower edge running along the lower frame member, the windshield substantially hiding the lower frame member.

According to yet another embodiment, the upper edge of the windshield and the upper frame member together define an upper channel and further wherein the lower edge of the windshield, the boat deck and the lower frame member together define a lower channel, the upper channel and the lower channel for use in securing a boat covering device to the boat windshield assembly.

According to another embodiment, there is provided a hidden frame structure for use in securing a boat covering device to a boat windshield for installation on a boat deck, the boat windshield comprising an upper edge, the hidden frame structure comprising: an upper frame member comprising: an upper frame attachment section; and a ledge extending from and above the upper frame attachment section; wherein when the boat windshield is installed on the hidden frame structure, the upper edge of the boat windshield runs along the upper frame member and the upper edge of the windshield and the upper frame member together define an upper channel for use in securing the boat covering device to the boat windshield.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed boat windshield assemblies with a hidden frame structure.

Figure 1:
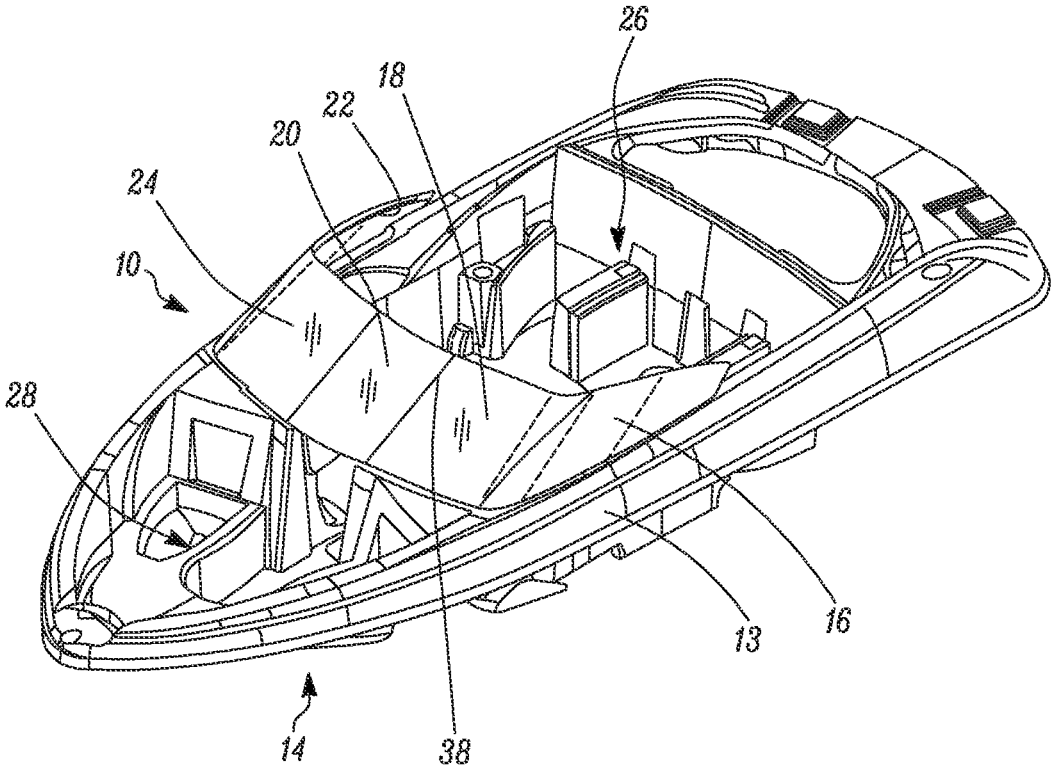
FIG. 1 is a perspective view of a boat which has a boat windshield assembly with a hidden frame structure in accordance with an embodiment.

Referring now to the drawings, and more particularly to FIG. 1, there is shown a boat windshield assembly 10 with a hidden frame structure (not shown) mounted on a boat deck 13 of a boat 14. The boat windshield assembly 10 comprises a first lateral windshield 16, a first frontal windshield 18, a central frontal windshield 20, a second lateral windshield 22 and a second frontal windshield 24. As shown in FIG. 1, the central frontal windshield 20 is also a door hinged to the hidden frame structure 12 (FIG. 3) or directly to the first frontal windshield 18 for allowing passage between the rear seating area 26 and the front seating area 28. It is to be noted that the boat windshield assembly 10 may include more or less windshields compared to the a first lateral windshield 16, the first frontal windshield 18, the central frontal windshield 20, the second lateral windshield 22 and a second frontal windshield 24 described above.

Figure 2:
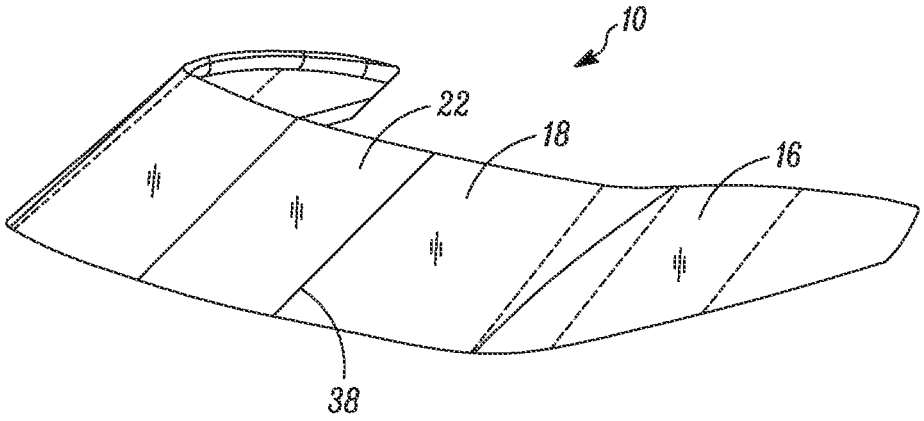
FIG. 2 is a perspective view of the boat windshield assembly with a hidden frame structure of FIG. 1.
Figure 3:
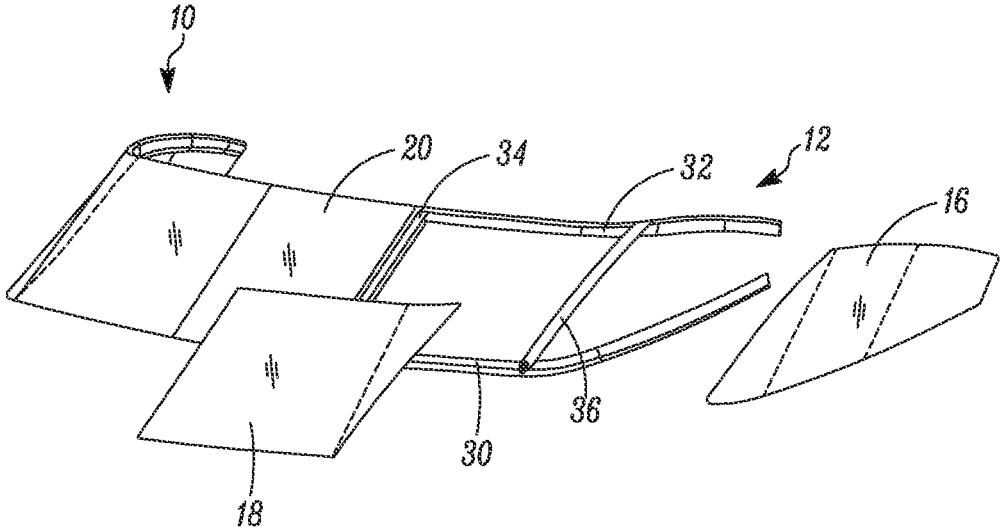
FIG. 3 is a perspective partially exploded view of the boat windshield assembly with a hidden frame structure of FIG. 2 revealing part of the hidden frame structure.
Figure 4:
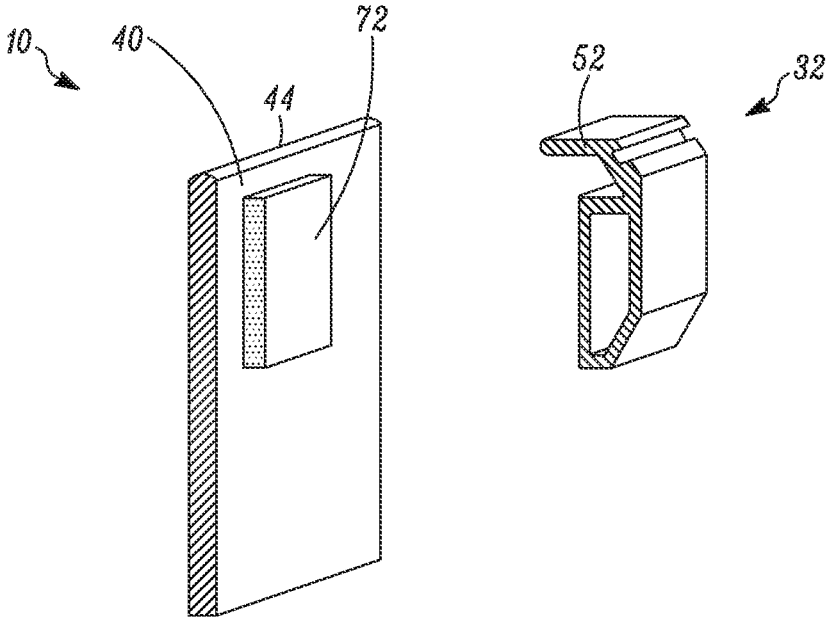
FIG. 4 is a perspective exploded cutout view of a portion of a windshield, an adhesive material and an upper frame member of the boat windshield assembly with a hidden frame structure of FIG. 2.
Figure 5:
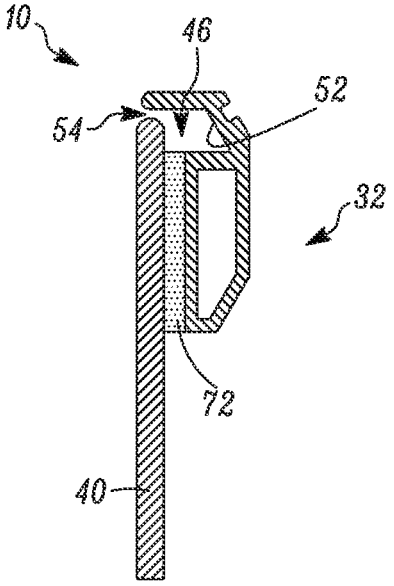
FIG. 5 is an elevation cross sectional view of the portion of the windshield, the adhesive material and the upper frame member of the boat windshield assembly with a hidden frame structure of FIG. 4.

Referring now to FIGS. 2-3, there is shown the boat windshield assembly 10 with the hidden frame structure 12 (FIG. 3). FIG. 3 illustrates a hidden frame structure 12 which is to be mounted on the boat deck 13. The hidden frame structure 12 includes a lower frame member 30 to be mounted on the boat deck 13, and an upper frame member 32 which is distant from the lower frame member 30 and a plurality of lateral frame members 34. The hidden frame structure 12 may further include one or a plurality of non-supporting frame members, such as non-supporting frame member 36 shown in FIG. 3. In FIGS. 2 and 3, there is further shown a hinge device 38 which links together and allows opening of the central frontal windshield 20 over first frontal windshield 18. The lower frame member 30, the upper frame member 32, the plurality of lateral frame members 34 and the non-supporting frame member 36 may be made of, without limitation, aluminum, stainless steel, any plastic material, any composite material, any other suitable material and the like.

Referring now to FIGS. 4-9, there is shown the upper portion of a boat windshield assembly 10 for installation on a boat deck 13. The boat windshield assembly 10 includes a hidden frame structure 12 which has an upper frame member 32. The boat windshield assembly 10 further includes a windshield 40 (i.e., which may comprise one of windshields 16, 18, 20, 22, 24) which defines a lower edge 42 and an upper edge 44 opposite the lower edge 42. The lower edge 42 runs near the boat deck 13 (FIGS. 1-3 and 10-25) and the upper edge 44 runs near the upper frame member 32 (FIGS. 1-9). The windshield 40 substantially hides the upper frame member 32. The upper edge 44 of the windshield 40 and the upper frame member 32 together define an upper channel 46 for use in securing a boat covering device 48 to the boat windshield assembly 10. It should be noted that, in this embodiment, the upper channel 46 is "open" in that a longitudinal access (upper passage 54) is provided to the upper channel 46.

Windshield 40 can be made of or comprises many types of materials including, but not limited to glass, plastic, glass and plastic laminates (e.g., laminated safety glass), polycarbonates, acrylic plastic, etc.

Still referring to FIGS. 4-9, there is shown that the upper frame member 32 further includes an upper frame attachment section 50 for attachment to the windshield 40 and a ledge 52 which extends from and above the upper frame attachment section 50. The upper edge 44 and the ledge 52 run parallel to each other and form an upper passage 54 to access the upper channel 46. While it is shown that the ledge 52 extends above both the upper frame attachment section 50 and the upper edge 44 of the windshield 40, it is also envisaged, in another embodiment (not shown), that the ledge 52 would, while still extend above the upper frame attachment section 50, but would remain behind the upper edge 44 while still leaving an upper passage 54. In such an embodiment, the upper passage 54 would provide access to the upper channel 46 from the top while it is shown to be provided from the side in FIGS. 4-9.

Figure 8:
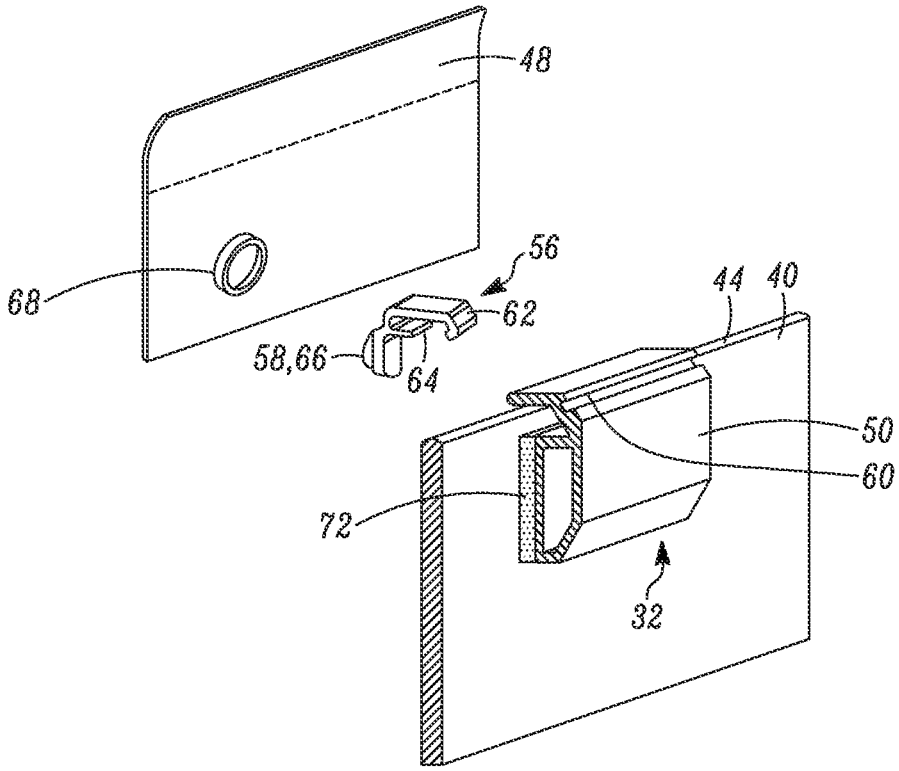
FIG. 8 is a perspective cutout view of a portion of a windshield, an adhesive material and an upper frame member of the boat windshield assembly with a hidden frame structure of FIG. 2, showing an uninstalled boat covering device and an upper frame attachment device in accordance with another embodiment.
Figure 9:
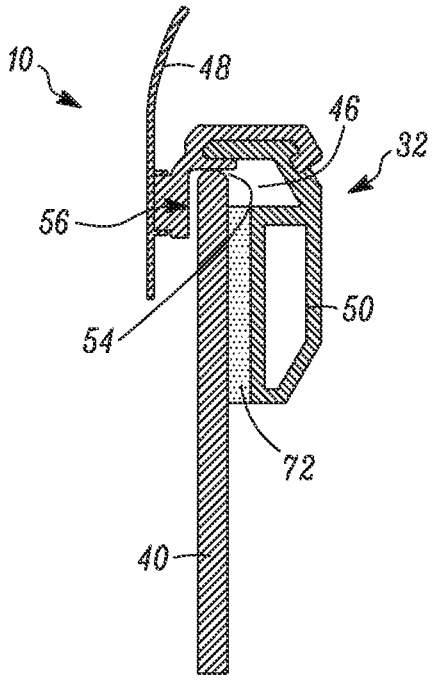
FIG. 9 is an elevation cross sectional view of the portion of the windshield, the adhesive material and the upper frame member of the boat windshield assembly with a hidden frame structure of FIG. 8, showing the upper frame attachment device which connects with the boat covering device and the upper frame member.
Figure 11:
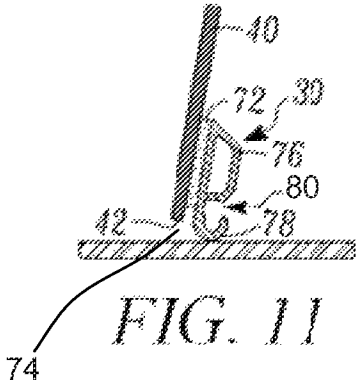
FIG. 11 is an elevation cross sectional view of the portion of the boat deck, the windshield, the adhesive material and the lower frame member of the windshield with a hidden frame structure of FIG. 10 defining a lower channel and a lower track.
Figure 14:
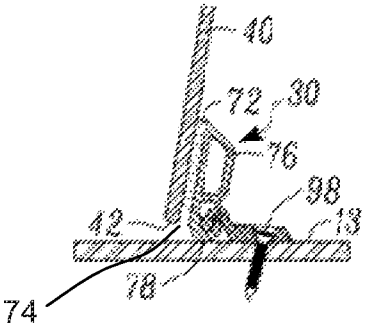
FIG. 14 is an elevation cross-sectional view of the portion of the deck, the windshield, the adhesive material and the lower frame member of the windshield with a hidden frame structure of FIG. 13, showing the lower frame attachment device attached to the boat deck and connecting with the lower track of the lower frame member.
Figure 10:
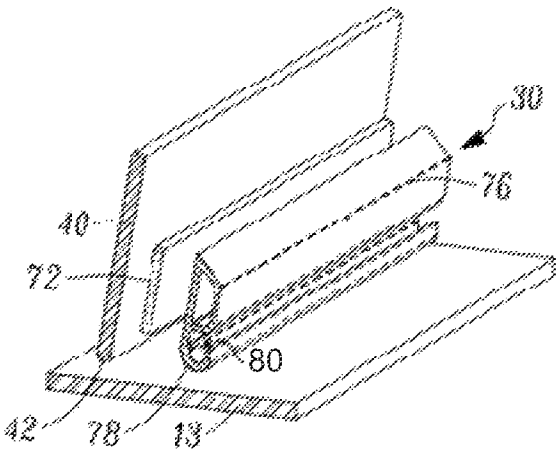
FIG. 10 is a perspective exploded cutout view of a portion of a boat deck, a windshield, an adhesive material and an lower frame member of the windshield with a hidden frame structure of FIG. 2.
Figure 12:
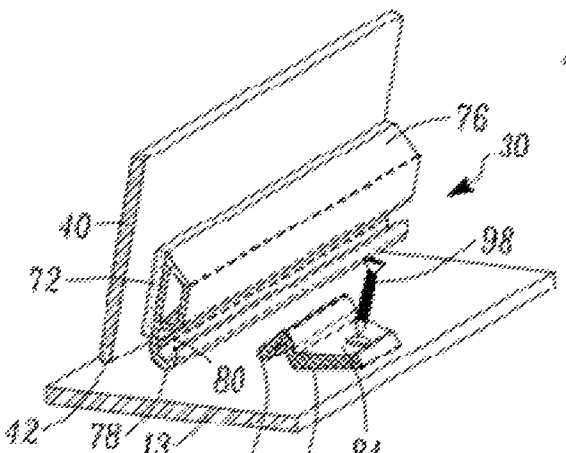
FIG. 12 is a perspective exploded cutout view of the portion of the boat deck, the windshield, the adhesive material and the lower frame member of the windshield with a hidden frame structure of FIG. 10, showing a lower frame attachment device to be attached to the boat deck for connecting with the lower track of the lower frame member in accordance with another embodiment.
Figure 13:
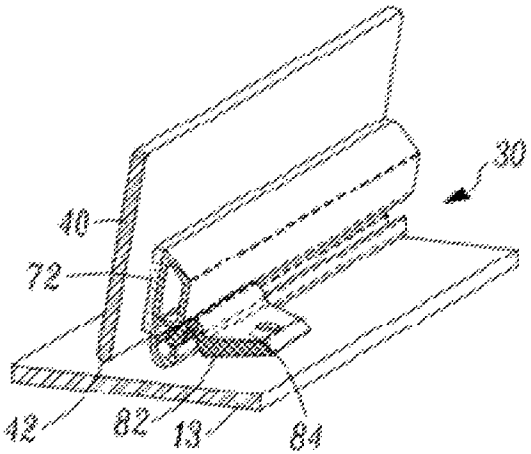
FIG. 13 is a perspective cutout view of the portion of the deck, the windshield, the adhesive material and the lower frame member of the windshield with a hidden frame structure of FIG. 10, showing the lower frame attachment device attached to the boat deck and connecting with the lower track of the lower frame member.
Figure 21:
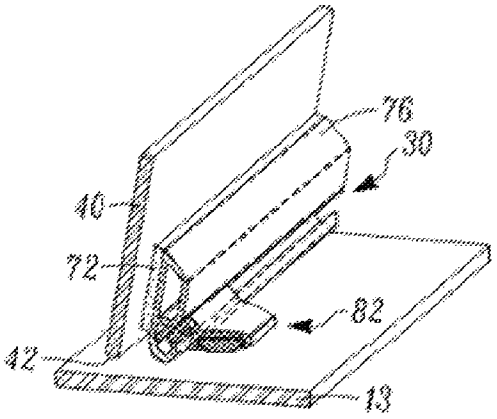
FIG. 21 is a perspective view of the portion of the deck, the windshield, the adhesive material and the lower frame member of the windshield with a hidden frame structure of FIG. 17, showing the lower frame attachment device attached to the boat deck and connecting with the lower track of the lower frame member.
Figure 20:
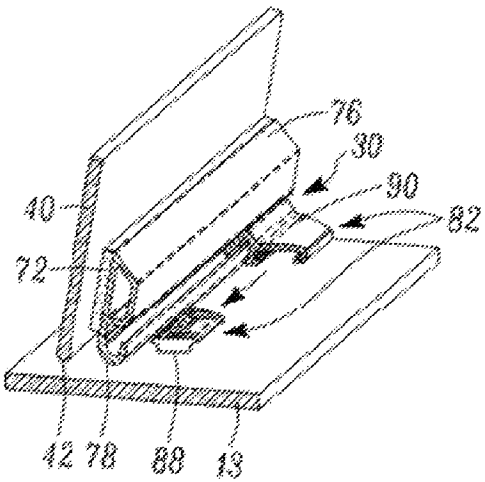
FIG. 20 is a perspective view of the portion of the deck, the windshield, the adhesive material and the lower frame member of the windshield with a hidden frame structure of FIG. 17, showing a portion of the lower frame attachment device attached to the boat deck for connecting with the lower track of the lower frame member.
Figure 19:
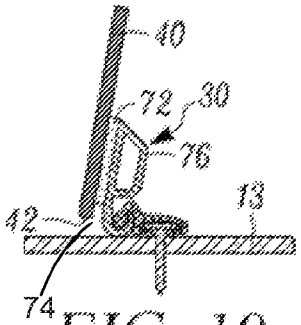
FIG. 19 is an elevation cross-sectional view of the portion of the deck, the windshield, the adhesive material and the lower frame member of the windshield with a hidden frame structure of FIG. 17, showing the lower frame attachment device attached to the boat deck and connecting with the lower track of the lower frame member.
Figure 17:
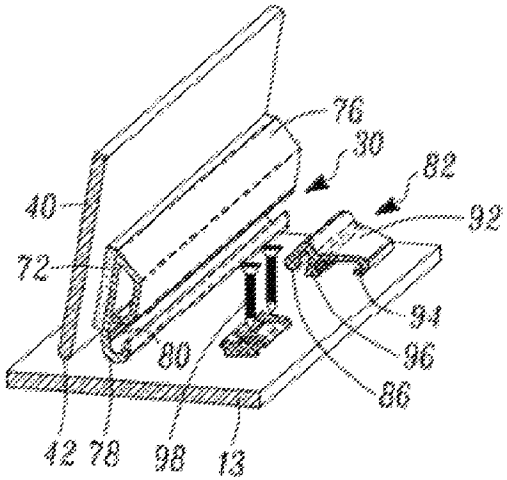
FIG. 17 is a perspective partially exploded cutout view of the portion of the boat deck, the windshield, the adhesive material and the lower frame member of the windshield with a hidden frame structure of FIG. 15, showing a lower frame attachment device to be attached to the boat deck for connecting with the lower track of the lower frame member in accordance with another embodiment.
Figure 18:
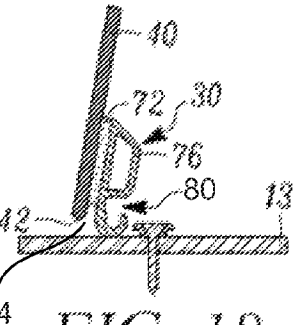
FIG. 18 is an elevation cross-sectional view of the portion of the deck, the windshield, the adhesive material and the lower frame member of the windshield with a hidden frame structure of FIG. 17, showing a portion of the lower frame attachment device attached to the boat deck for connecting with the lower track of the lower frame member.
Figure 16:
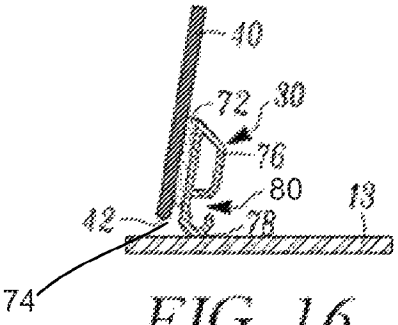
FIG. 16 is an elevation cross sectional view of the portion of the boat deck, the windshield, the adhesive material and the lower frame member of the windshield with a hidden frame structure of FIG. 15 defining a lower channel and a lower track.
Figure 15:
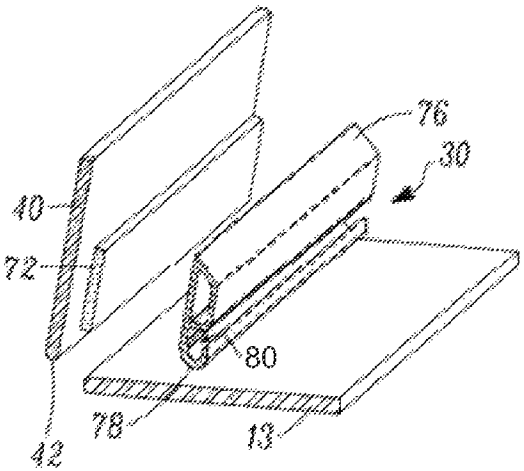
FIG. 15 is a perspective exploded cutout view of a portion of a boat deck, a windshield, an adhesive material and an lower frame member of the windshield with a hidden frame structure of FIG. 2.
Figure 22:
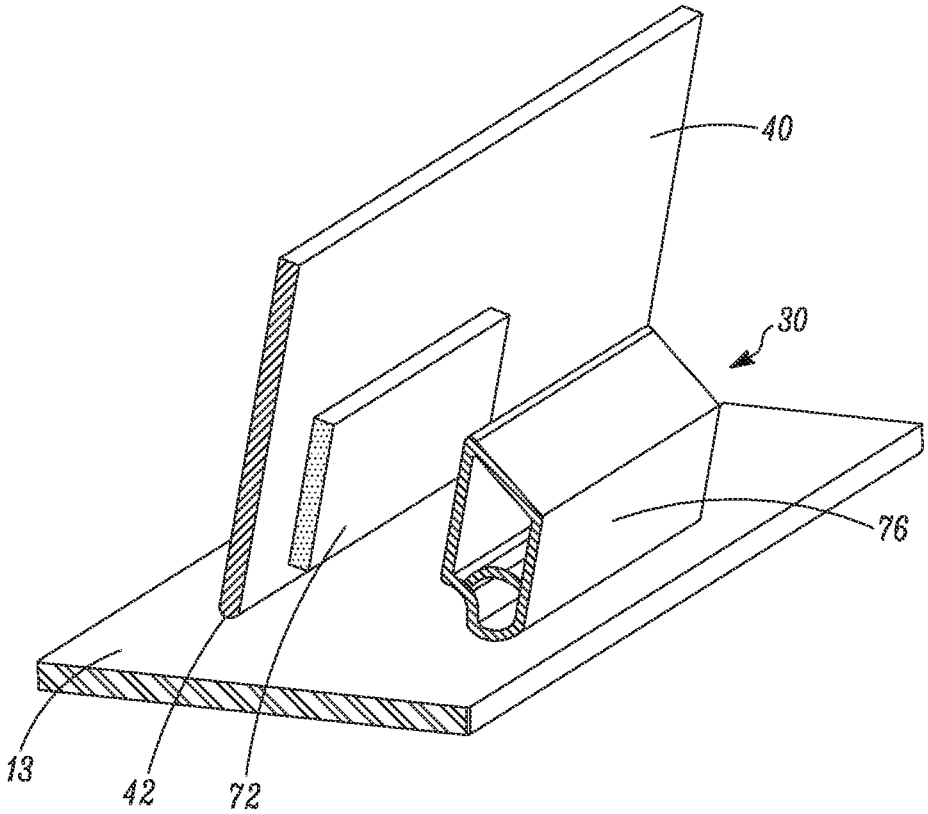
FIG. 22 is a perspective cutout view of a portion of a boat deck, a windshield, an adhesive material and an lower frame member of the windshield with a hidden frame structure of FIG. 2.
Figure 23:
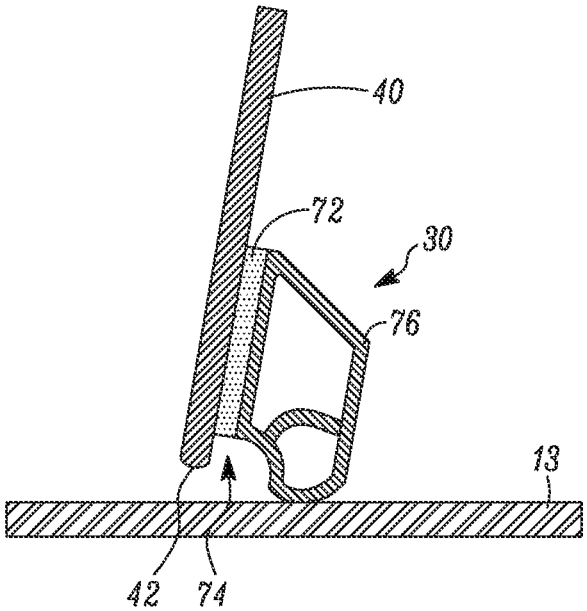
FIG. 23 is an elevation cross sectional view of the portion of the boat deck, the windshield, the adhesive material and the lower frame member of the windshield with a hidden frame structure of FIG. 22 defining a lower channel.
Figure 24:
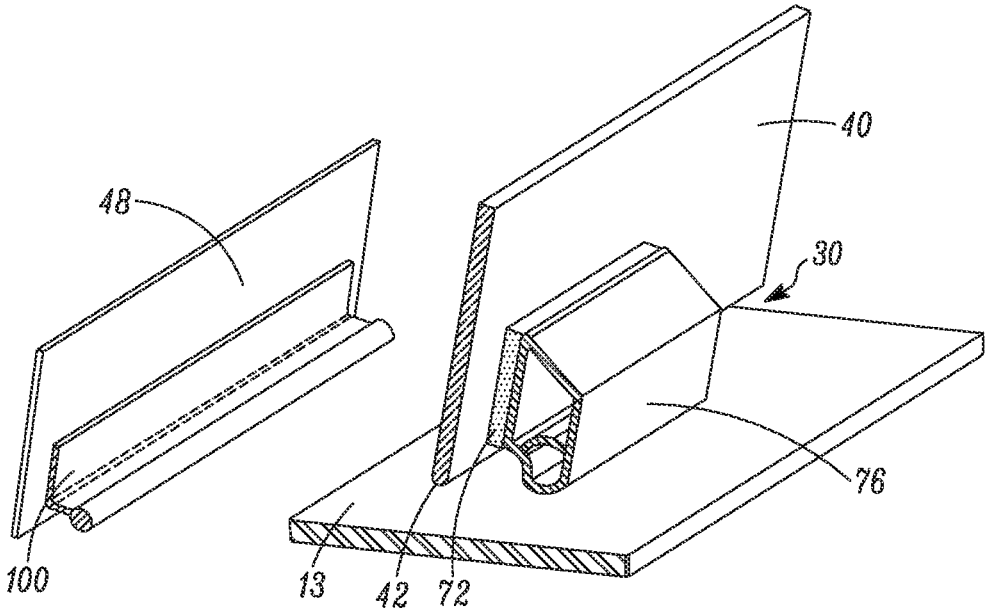
FIG. 24 is a perspective view of the portion of the boat deck, the windshield, the adhesive material and an lower frame member of the windshield of FIG. 2, showing a boat covering device molding of a boat covering device.
Figure 25:
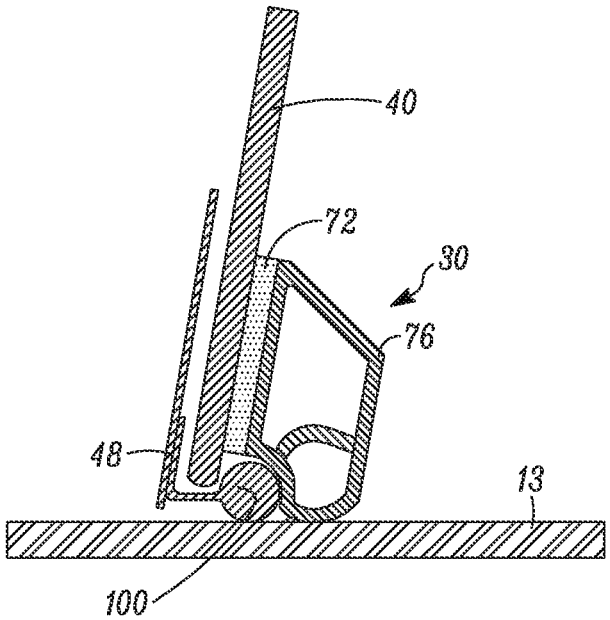
FIG. 25 is an elevation cross sectional view of the portion of the boat deck, the windshield, the adhesive material and the lower frame member on the boat deck of the windshield of FIG. 2, showing the lower channel receiving the boat covering device molding.

Referring now to FIGS. 8-9 and according to one embodiment, the boat windshield assembly 10 may further include an upper frame attachment device 56 to be removably mounted on the upper frame member 32. The upper frame attachment device 56 may include a fastener 58 for removably connecting with a boat covering device 48. The upper frame member 32 may include a longitudinal groove 60 and the upper frame attachment device 56 may include a first lip 62 and a second lip 64 as shown in FIGS. 8-9. The second lip 64 is for introduction in the upper passage 54 while the first lip 62 is for introduction in the longitudinal groove 60, thereby securing the upper frame attachment device 56 to the upper frame member 32.

Still referring to FIGS. 8-9, the fastener 58 of the upper frame attachment device 56 may include a snap fastener 66 for removably connecting with a corresponding fastener 68 on the boat covering device 48.

Figure 6:
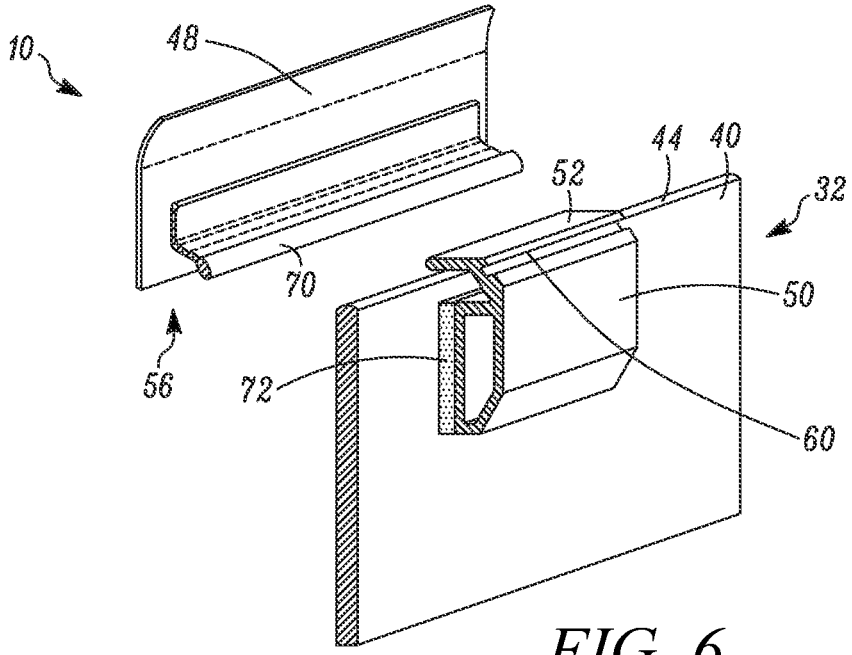
FIG. 6 is a perspective cutout view of a portion of a windshield, an adhesive material and an upper frame member of the boat windshield assembly with a hidden frame structure of FIG. 2, showing an uninstalled boat covering device with a boat covering device molding in accordance with another embodiment.
Figure 7:
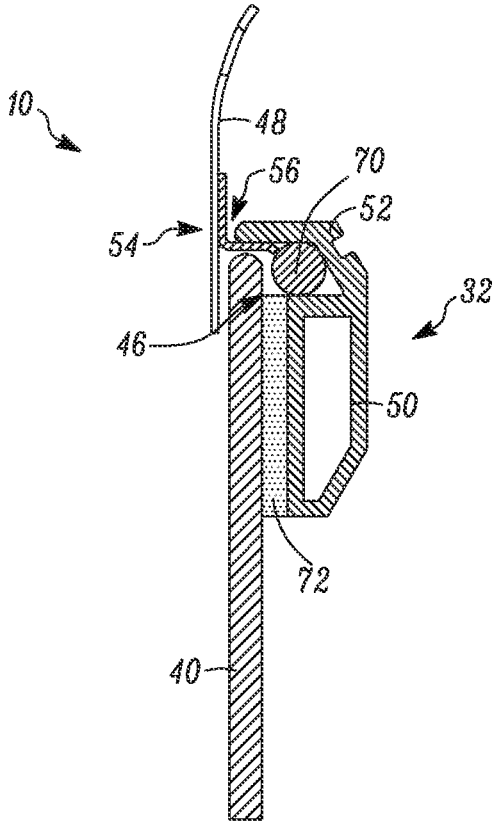
FIG. 7 is an elevation cross sectional view of the portion of the windshield, the adhesive material and the upper frame member of the boat windshield assembly with a hidden frame structure of FIG. 6, showing an upper channel receiving the boat covering device molding.

Referring now to FIGS. 6-7 and according to one embodiment, the boat windshield assembly 10 may alternatively include a boat covering device molding 70 which is slidably mounted within the upper channel 46 of the upper frame member 32. The boat covering device molding 70 is attached to the boat covering device 48.

According to one embodiment and referring to FIGS. 4-9, the boat windshield assembly 10 includes an adhesive material 72 which fixes a portion of a surface defined by the windshield 40 near the upper edge 44 to a portion of a surface defined by the hidden frame structure 12.

According to one embodiment and referring now to FIGS. 10-21, the hidden frame structure 12 may further include a lower frame member 30. The lower edge 42 of the windshield 40 runs near the lower frame member 30 and forms a lower channel 74 between a lower frame attachment section 76, the boat deck 13 and the windshield 40. As shown, a portion of the lower frame member 30 defines a lower track 80 for use in securing the boat windshield assembly 10 to the boat deck 13. The lower edge of the windshield 40, the boat deck 13 and the lower frame member 30 together define a lower channel (shown, but not numbered)

Still referring to FIGS. 10-21, there is shown that the lower frame member 30 further includes a lower frame attachment section 76 for attachment to the windshield 40 and a ledge 78 extending from and below the lower frame attachment section 76. The lower frame attachment section 76 and the ledge 78 together form the lower track 80.

Still referring to FIGS. 10-21, there is shown that the boat windshield assembly 10 further includes a lower frame attachment device 82 to be mounted on the boat deck 13. The lower frame attachment device 82 includes a mounting section 84 and a lip 86 which extends outwardly and downwardly from the mounting section 84. The lip 86 of the lower frame attachment device 82 is slidably mounted over the ledge 78 within the lower track 80 of the lower frame member 30.

Now referring to FIGS. 15-21, there is shown that the mounting section 84 of the lower frame attachment device 82 may include a fixed mounting section 88 to be mounted on the boat deck 13 and a removable mounting section 90 to be slidably mounted on the fixed mounting section 88. As shown, the removable mounting section 90 includes an interfacing flat portion 92, a first lip 94 and a second lip 96. The first lip 94 and the second lip 96 each extends from and below the interfacing flat portion 92 for slidably engaging with sides of the fixed mounting section 88.

As shown in FIGS. 10-21, the lower frame attachment device 82 of the boat windshield assembly 10 may include one or more fasteners 98 for connecting with the boat deck 13.

Now referring to FIGS. 22-25, there is shown that the hidden frame structure 12 may include a lower frame member 30, where the lower edge 42 of the windshield 40 runs near the lower frame member 30. In this configuration, a portion of the lower frame member 30 defines a lower channel 74 for use in securing the boat covering device 48 to the boat windshield assembly 10. As shown, the boat windshield assembly 10 further includes a boat covering device molding 100 to be slidably mounted within the lower channel 74 of the lower frame member 30. The boat covering device molding 100 connects with the boat covering device 48.

According to one embodiment, and referring to FIGS. 10-25, there is shown that the boat windshield assembly 10 further includes an adhesive material 72 which fixes a portion of a surface defined by the windshield 40 near the lower edge 42 to a portion of a surface defined by the hidden frame structure 12.

In the embodiment shown in FIGS. 1-3, it is to be noted that the upper frame member 32 and the lower frame member 30 each comprise two parts. The two parts are the respective left and right parts which may be mirror images of each other. In this embodiment, there are two lateral frame members 34.

The lower frame and upper frame attachment devices 56, 82, including fastener 58, may be made, without limitation, of at least one of a PVC material, a nylon material and any other suitable materials.

It is to be noted that the adhesive material 72 may include, without limitation, at least one of a polyurethane material, a silicone material and any other suitable material for connecting the windshield 40 to a hidden frame structure 12.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A boat windshield assembly for installation on a boat deck, the boat windshield assembly comprising:

a frame structure having an upper frame member; and a windshield comprising an upper edge running along the upper frame member when installed on the frame structure, the windshield substantially in front of the upper frame member;

wherein the upper edge of the windshield and the upper frame member together define an upper channel for use in securing a boat covering device to the boat windshield assembly;

wherein the upper frame member further comprises an upper frame attachment section for attachment to the windshield and a ledge extending from and above the upper frame attachment section, wherein the upper edge and the ledge run parallel to each other and form an upper passage to access the upper channel; and further wherein at least a portion of the ledge remains below and behind the upper edge.

2. The boat windshield assembly of claim 1, wherein at least a portion of the ledge extends above the upper edge.

3. The boat windshield assembly of claim 1, further comprising an upper frame attachment device removably mounted on the upper frame member, the upper frame attachment device comprising a fastener for removably connecting with a boat covering device.

4. The boat windshield assembly of claim 3, wherein the upper frame member comprises a longitudinal groove and wherein the upper frame attachment device comprises a first lip and a second lip, the second lip is for introduction in the upper passage while the first lip is for introduction in the longitudinal groove thereby securing the upper frame attachment device to the upper frame member.

5. The boat windshield assembly of claim 3, wherein the fastener of the upper frame attachment device comprises a snap fastener for removably connecting with a corresponding fastener on the boat covering device.

6. The boat windshield assembly of claim 1, further comprising a boat covering device molding slidably mounted within the upper channel of the upper frame member, the boat covering device molding being attached to the boat covering device.

7. The boat windshield assembly of claim 1, wherein the frame structure further comprises a lower frame member and the windshield comprises a lower edge opposite the upper edge, the lower edge running along the lower frame member, the windshield substantially in front of the lower frame member.

8. The boat windshield assembly of claim 7, wherein the frame structure comprises a frame structure surface on the frame structure, the boat windshield assembly further comprises an adhesive material for fixing the windshield to the frame structure surface.

9. The boat windshield assembly of claim 7, wherein the lower frame member comprises a lower track for use in securing the boat windshield assembly to the boat deck.

10. The boat windshield assembly of claim 7, wherein the lower frame member further comprises a lower frame attachment section for attachment to the windshield and a ledge extending from and below the lower frame attachment section, wherein the lower frame attachment section, the boat deck and the ledge together form a lower channel, the lower channel for use in securing the boat covering device to the boat windshield assembly.

11. The boat windshield assembly of claim 10, wherein the lower frame attachment section comprises a lower track, and the boat windshield assembly further comprises a lower frame attachment device for mounting on the boat deck, the lower frame attachment device comprising a mounting section and a lip extending outwardly and downwardly from the mounting section, the lip of the lower frame attachment device for slidably mounting on the lower track.

12. The boat windshield assembly of claim 11, wherein the mounting section of the lower frame attachment device comprises a fixed mounting section mounted on the boat deck and a removable mounting section for slidably mounting on the fixed mounting section.

13. The boat windshield assembly of claim 12, wherein the removable mounting section comprises an interfacing flat portion, a first lip and a second lip, the first lip and the second lip extending from and below the interfacing flat portion for slidably engaging with sides of the interfacing flat portion.

14. The boat windshield assembly of claim 10, further comprising a boat covering device molding slidably mounted within the lower channel of the lower frame member, the boat covering device molding connecting with a boat covering device.

15. A boat windshield assembly for installation on a boat deck, the boat windshield assembly comprising:

a frame structure having an upper frame member; and a windshield comprising an upper edge running along the upper frame member when installed on the frame structure, the windshield substantially in front of the upper frame member, wherein the frame structure further comprises a lower frame member and the windshield comprises a lower edge opposite the upper edge, the lower edge running along the lower frame member, the windshield substantially in front of the lower frame member;

wherein the upper edge of the windshield and the upper frame member together define an upper channel and further wherein the lower edge of the windshield, the boat deck and the lower frame member together define a lower channel, the upper channel and the lower channel for use in securing a boat covering device to the boat windshield assembly, the upper frame member comprising an upper frame attachment section for attachment to the windshield and a ledge extending from and above the upper frame attachment section, the upper edge and the ledge running parallel to each other and forming an upper passage to access the upper channel, at least a portion of the ledge remaining below and behind the upper edge.

16. A frame structure for use in securing a boat covering device to a boat windshield for installation on a boat deck, the boat windshield comprising an upper edge, the frame structure comprising:

an upper frame member comprising:

an upper frame attachment section; and a ledge extending from and above the upper frame attachment section;

wherein when the boat windshield is installed on the frame structure, the upper edge of the boat windshield runs along the upper frame member and the upper edge of the windshield and the upper frame member together define an upper channel for use in securing the boat covering device to the boat windshield, the upper edge and the ledge running parallel to each other and forming an upper passage to access the upper channel, at least a portion of the ledge remaining below and behind the upper edge.

* * * * *